US006782949B2

(12) United States Patent
Cove et al.

(10) Patent No.: US 6,782,949 B2
(45) Date of Patent: Aug. 31, 2004

(54) CHOKE VALVE WITH PRESSURE TRANSMITTERS

(75) Inventors: Harry Richard Cove, Edmonton (CA); Larry J. Bohaychuk, Mundare (CA)

(73) Assignee: Master Flo Valve Inc., Edmonton (CA)

( * ) Notice: Subject to any disclaimer, the term of this patent is extended or adjusted under 35 U.S.C. 154(b) by 0 days.

(21) Appl. No.: 10/060,559

(22) Filed: Jan. 29, 2002

(65) Prior Publication Data

US 2003/0141072 A1 Jul. 31, 2003

(51) Int. Cl.[7] ..... E21B 29/12

(52) U.S. Cl. ..... 166/368; 166/336; 166/91.1; 137/554

(58) Field of Search ..... 166/336, 337, 166/368, 91.1; 175/219; 137/606, 556, 554

(56) References Cited

U.S. PATENT DOCUMENTS 4,044,834 A * 8/1977 Perkins ..... 166/370
4,470,430 A * 9/1984 Lancaster ..... 137/315.02
4,862,426 A * 8/1989 Cassity et al. ..... 367/81
5,887,657 A * 3/1999 Bussear et al. ..... 166/336

* cited by examiner

*Primary Examiner*—Thomas B. Will
*Assistant Examiner*—Thomas A. Beach
(74) *Attorney, Agent, or Firm*—Macheledt Bales Heidmiller LLP

(57) ABSTRACT

In a sub-sea wellhead insert-type choke valve having a bonnet, a pair of pressure transmitters are mounted in the bonnet. One transmitter is connected by a passageway with the annular clearance between the cartridge of the insert assembly and the valve body. This transmitter measures the pressure of the fluid in the clearance and transmits signals indicative thereof to a receiver at surface. The other transmitter is connected by a passageway with the fluid in the valve outlet, measures the pressure of this fluid and transmits signals indicative thereof to the receiver. In this way the high and low pressures upstream and downstream of the choke valve flow trim are monitored by transmitters, which can be serviced by bringing the insert assembly to surface.

2 Claims, 4 Drawing Sheets

CHOKE VALVE WITH PRESSURE TRANSMITTERS

FIELD OF THE INVENTION

The present invention relates to a sub-sea choke valve having pressure sensing transmitters.

BACKGROUND OF THE INVENTION

A choke valve is a throttling device. It is commonly used as part of an oil or gas field wellhead. It functions to reduce the pressure of the fluid flowing through the valve. Choke valves are placed on the production "tree" of an oil or gas wellhead assembly to control the flow of produced fluid from a reservoir into the production flow line. They are used on wellheads located on land and on off-shore wellheads located beneath the surface of the ocean.

A choke valve incorporates what is referred to as a "flow trim". The flow trim is positioned within the choke valve at the intersection of the choke valve's inlet and outlet. The flow trim commonly comprises a stationary tubular cylinder referred to as a "cage". The cage is positioned transverse to the inlet and its bore is axially aligned with the outlet. The cage has restrictive flow ports extending through its side-wall. Fluid enters the cage from the choke valve inlet, passes through the ports and changes direction to leave the cage bore through the valve outlet.

Such a flow trim also comprises a tubular throttling sleeve that slides over the cage. The sleeve acts to reduce or increase the area of the ports. An actuator, such as a threaded stem assembly, is provided to bias the sleeve back and forth along the cage. The amount of fluid that passes through the flow trim is dependent on the relative position of the sleeve on the cage and the amount of port area that is revealed by the sleeve.

Sub-sea oil or gas wells can be as deep as 6000 feet below sea level. At these depths, maintenance on the wellhead assemblies cannot be performed manually. An unmanned, remotely operated vehicle, referred to as an "ROV", is used to approach the wellhead and carry out maintenance functions. To aid in servicing sub-sea choke valves, choke valves have their internal components, including the flow trim, assembled into a modular sub-assembly. The sub-assembly is referred to as an "insert assembly" and is inserted into the choke valve body and clamped into position.

A typical prior art sub-sea choke valve a is shown in FIG. 1. It comprises a choke body b forming a T-shaped bore c that provides a horizontal inlet d, a vertical bottom outlet e and an upper vertical component chamber f. A removable insert assembly g is positioned in the component chamber f, extending transversely of the inlet d. The insert assembly g comprises a tubular cartridge h, forming a side port i, a flow trim j comprising a cage k and throttling sleeve 1, a collar assembly m and a bonnet n. The bonnet n is disengagably clamped to the body b. It closes the upper ends of the valve body b and the cartridge h. The stem assembly m extends through the bonnet n into the cartridge bore o to bias the sleeve 1 along the cage k to throttle the restrictive flow ports p.

The choke valve 'sees' or experiences relatively high and relatively low fluid pressures. More particularly, the fluid flowing in through the valve inlet d from the well (not shown) has a high pressure. When the fluid passes through the restrictive cage ports p, it undergoes a considerable pressure drop. So the fluid passing through the cage bore q and the valve outlet e is at lower pressure than that in the body inlet d.

The high pressure fluid penetrates into an annular clearance r between the cartridge h and the internal bore surface s of the body b. Also, the low pressure fluid in the cage bore q and valve outlet e penetrates through communication ports t in the end wall of the throttling sleeve 1 and into a passageway u extending partway along the length of the collar assembly m.

When the flow trim j becomes worn beyond its useful service life due to erosion and corrosion caused by particles and corrosive agents in the produced substances, an ROV is used to approach the choke valve a, unclamp the insert assembly g from the choke valve body b and attach a cable to the insert assembly g, so that it may be raised to the surface for replacement or repair. The ROV then installs a new insert assembly and clamps it into position. This procedure eliminates the need to raise the whole wellhead assembly to the surface to service a worn choke valve.

In order to efficiently produce a reservoir, it is necessary to monitor the pressure upstream and downstream of the choke valve. This is done to ensure that damage to the formation does not occur and to ensure that well production is maximized. This process has been, historically, accomplished through the installation of pressure transmitters into the flow lines upstream and downstream of the choke valve. The pressure read by the upstream and downstream pressure transmitters is sent to a remote location for monitoring, so that a choke valve controller can remotely bias the flow trim to affect the desired downstream flow line pressure. The controller sends electrical signals to means, associated with the choke valve, for adjusting the flow trim.

A problem, however, exists with this process due to the unreliable nature of these electronic pressure transmitters, which have a limited service life. Replacing the pressure transmitters after they have served their useful life has heretofore required that the whole wellhead assembly be raised to the surface. This is a time-consuming and costly operation that shuts down well production for the duration of the repair.

The present invention proposes a modified choke valve that eliminates the need to raise a sub-sea wellhead assembly to the surface to replace or repair pressure transmitters.

SUMMARY OF THE INVENTION

The invention involves locating one or preferably a pair of pressure transmitters in the upper end of the bonnet of the insert assembly. One transmitter is connected by a first passageway extending through the bonnet to communicate with the annular clearance between the cartridge and the valve body. This transmitter thus can measure the high pressure of the incoming fluid and transmit a signal indicative thereof to a remote receiver. A second transmitter is connected by a second passageway, extending through the bonnet, which communicates with the valve outlet. This transmitter thus can measure the pressure of the fluid that has undergone a pressure drop by passing through the flow trim. It can transmit a signal indicative of this reduced pressure to the remote receiver.

By positioning one or both of the transmitters in the bonnet of the removable insert assembly, they can now be replaced or repaired economically by bringing the choke insert assembly to surface.

DESCRIPTION OF THE PREFERRED EMBODIMENT

Figure 1:
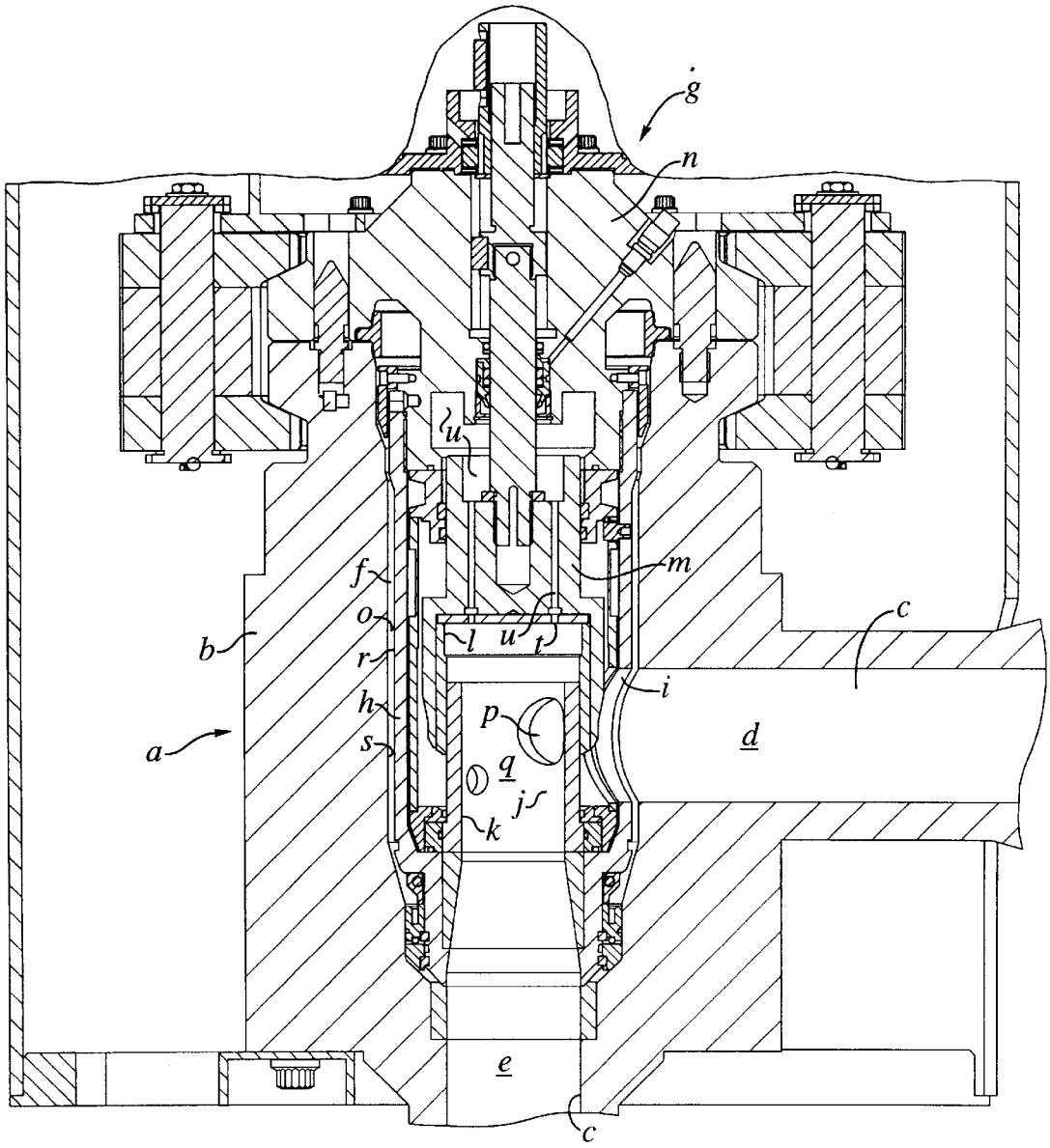
FIG. 1 (Prior Art)
FIG. 1 is a cross-sectional side view of a conventional sub-sea choke valve insert installed in a choke valve body.
Figure 2:
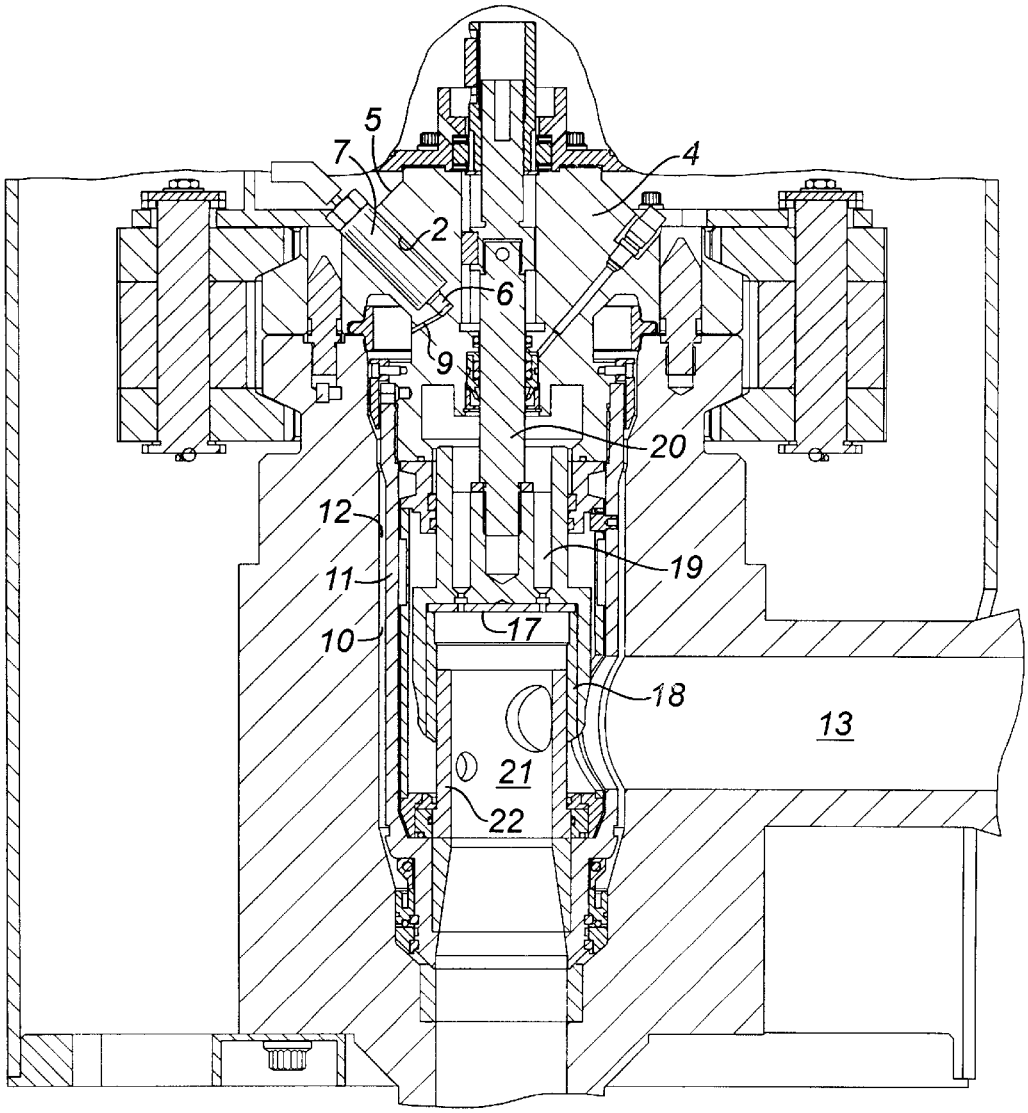
FIG. 2 is a cross-sectional side view of a modified choke valve having a pressure transmitter installed in the bonnet and connected with a passageway connecting with the annular clearance between the cartridge and valve body.
Figure 3:
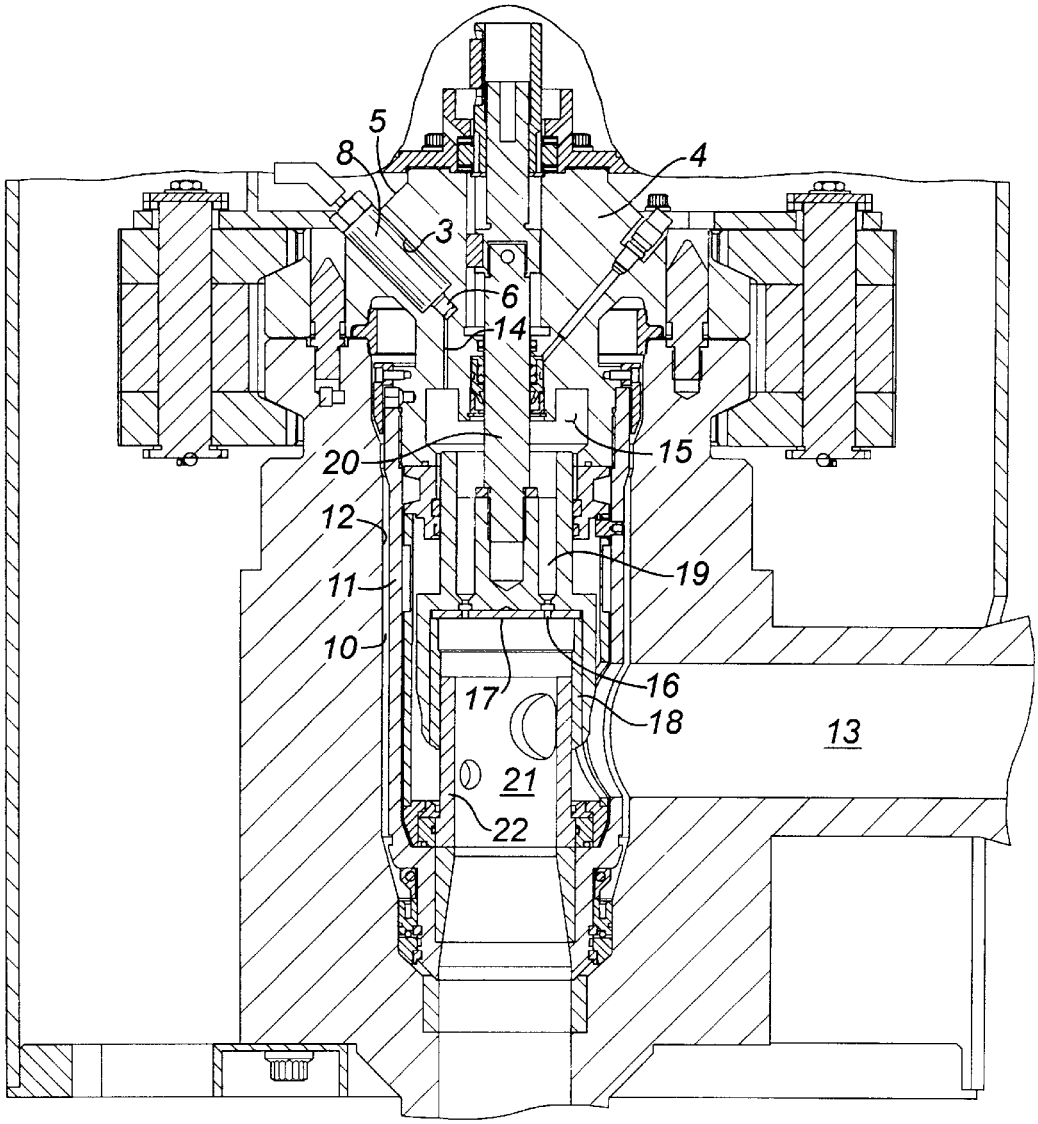
FIG. 3 is a cross-sectional side view of the choke valve of FIG. 2, showing a pressure transmitter installed in the bonnet and connected with a passageway communicating with the bore of the flow trim cage.
Figure 4:
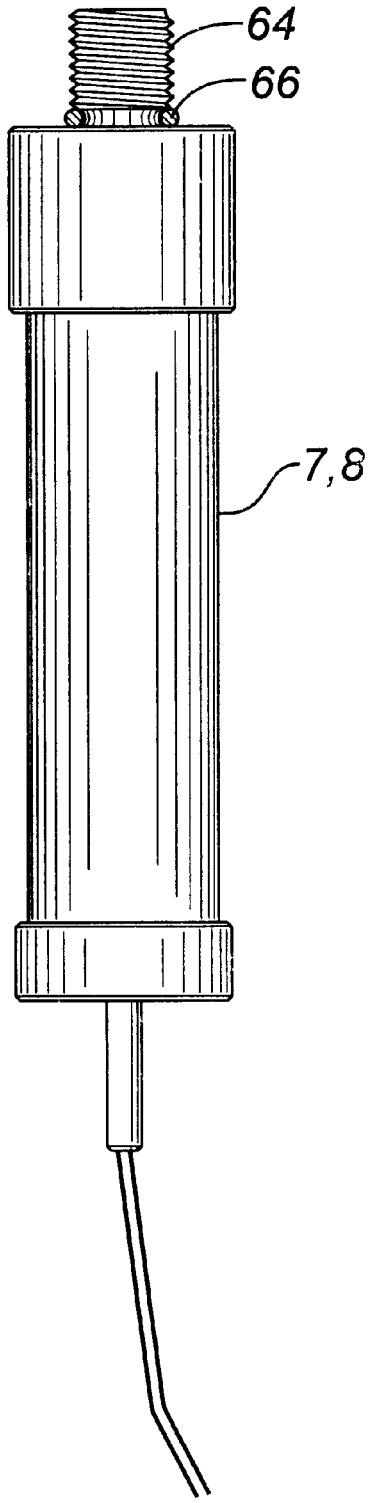
FIG. 4 is an external side view of a conventional pressure transmitter.

FIGS. 1–3 illustrate a choke valve 1 whose main components have been described in the Background section of this specification.

However the choke valve 1 has been modified in the following respects:

a pair of counterbores 2, 3 are provided, extending into the bonnet 4 from its top end surface 5;

the counterbores 2,3 are each internally threaded at 6;

a pair of known pressure transmitters 7,8, such as the product supplied by Custom Components of Edmonton, Alberta under designation #SK 010629, are positioned and screw-threaded in place in the counterbores 2,3. Each pressure transmitter is operative to measure pressure and transmit signals indicative thereof to a remote receiver (not shown);

the counterbore 2 is connected by a passageway 9 with the annular clearance 10, formed between the cartridge 11 and body bore surface 12. Thus the high pressure incoming fluid entering the body inlet 13 comes into contact with the transmitter 7 through the clearance 10 and passageway 9. The transmitter 7 can therefore monitor this pressure and transmit signals indicative thereon;

the counterbore 3 is connected by a passageway 14 with a passageway 15 formed by communication ports 16 in the end wall 17 of the throttling sleeve 18 and a passageway 19 leading through and along the stem assembly 20.

The fluid from the bore 21 of the cage 22 can therefore penetrate to the transmitter 8. This transmitter 8 can therefore monitor the reduced pressure of the fluid in the cage bore 21 and transmit signals indicative thereof to the receiver.

The embodiments of the invention in which an exclusive property or privilege is claimed are defined as follows:

1. A sub-sea choke valve comprising:

a valve body forming a bore extending therethrough which provides an inlet, an outlet and an insert chamber;

a removable insert assembly positioned in the insert chamber and comprising a tubular cartridge having a side wall forming an internal bore and having a port communicating with the body inlet, the cartridge having an outside surface forming an annular clearance with the body, whereby high pressure fluid entering through the body inlet penetrates into the clearance, a bonnet connected with and closing the ends of the cartridge and the body, the bonnet being disengagably connected with the body, a pressure reducing flow trim positioned in the cartridge bore, the flow trim having a restrictive opening whereby fluid from the body inlet may enter the flow trim at reduced pressure and pass through the outlet, the bonnet having an end surface, the bonnet forming a first passageway extending from its top end surface and communicating with the clearance, the bonnet further forming a second passageway extending from its end surface and communicating with the bottom outlet, a first pressure transmitter positioned within the bonnet and connected with the first passageway for measuring the high pressure in the clearance and transmitting signals indicative thereof, and a second pressure transmitter positioned within the bonnet and connected with the second passageway for measuring the reduced pressure in the bottom and transmitting signals indicative thereof.

2. A sub-sea choke valve comprising:

a valve body forming a T-shaped bore extending therethrough which provides a horizontal side inlet, a vertical bottom outlet and a vertical insert chamber;

a removable insert assembly positioned in the insert chamber and comprising a vertical tubular cartridge having a side wall forming an internal bore and having a side port communicating with the body inlet, the cartridge having an outside surface forming an annular clearance with the body, whereby high pressure fluid entering through the body inlet penetrates into the clearance, a bonnet connected with and closing the upper ends of the cartridge and the body, the bonnet being disengagably connected with the body, a pressure reducing flow trim positioned in the cartridge bore, the flow trim comprising a tubular cage, aligned with the body outlet, and a throttling sleeve slideable over the cage, the cage having a side wall forming an internal bore and restrictive flow ports aligned with the cartridge side port and the inlet, whereby fluid from the body inlet may enter the cage bore at reduced pressure and pass through the bottom outlet, stem means, extending through the bonnet, for biasing the throttling sleeve over the cage ports, the stem means and throttling sleeve combining to form a first passageway communicating with the cage bore and the bottom outlet, the bonnet having a top end surface, the bonnet forming a first passageway extending from its top end surface and communicating with the clearance, the bonnet further forming a second passageway extending from its top end surface and communicating with the bottom outlet through the cage bore, a first pressure transmitter positioned within the bonnet and connected with the first passageway for measuring the high pressure in the clearance and transmitting signals indicative thereof, and a second pressure transmitter positioned within the bonnet and connected with the second passageway for measuring the reduced pressure in the bottom outlet and transmitting signals indicative thereof.

* * * * *